US008736532B2

(12) United States Patent
Oh

(10) Patent No.: US 8,736,532 B2
(45) Date of Patent: May 27, 2014

(54) LIQUID CRYSTAL DISPLAY DEVICE HAVING A 1-DOT INVERSION OR 2-DOT INVERSION SCHEME AND METHOD THEREOF

(75) Inventor: Seung-Cheol Oh, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 142 days.

(21) Appl. No.: 13/333,140

(22) Filed: Dec. 21, 2011

(65) Prior Publication Data

US 2012/0162178 A1 Jun. 28, 2012

(30) Foreign Application Priority Data

Dec. 24, 2010 (KR) ..... 10-2010-0134951

(51) Int. Cl.
*G09G 3/36* (2006.01)

(52) U.S. Cl.
USPC ..... 345/96

(58) Field of Classification Search
USPC ..... 345/96
See application file for complete search history.

(56) References Cited

U.S. PATENT DOCUMENTS

| | | | | |
|---|---|---|---|---|
| 2005/0280622 | A1* | 12/2005 | Lee et al. | 345/96 |
| 2008/0001890 | A1* | 1/2008 | Song et al. | 345/96 |
| 2009/0251451 | A1* | 10/2009 | Cha et al. | 345/211 |
| 2011/0102471 | A1* | 5/2011 | Hsu et al. | 345/690 |

FOREIGN PATENT DOCUMENTS

| | | | |
|---|---|---|---|
| CN | 1702731 | A | 11/2005 |
| CN | 101556779 | A | 10/2009 |
| CN | 101847390 | A | 9/2010 |

* cited by examiner

*Primary Examiner* — Long D Pham
(74) *Attorney, Agent, or Firm* — Birch, Stewart, Kolasch & Birch, LLP

(57) ABSTRACT

A liquid crystal display device includes a liquid crystal panel including a plurality of gate lines (GL1 to GLn) data lines (DL1 to DLm) and a plurality of pixel areas; a timing controller arranging the external input image data to be proper to the driving of the liquid crystal panel, generating a gate control signal (GCS) and a data control signal (DCS), and grouping the arranged image data into a plurality of groups each having a plurality of controller channels, and outputting a group control signal (HINV_m) by determining whether the arranged image data for each group is proper to horzintal-1-dot inversion or horizontal-2-dot inversion; a gate driver driving the plurality of the gate lines of the liquid crystal panel based on the gate control signal (GCS) from the timing controller; and a data driver grouping output terminals into a plurality of groups.

9 Claims, 6 Drawing Sheets

FIG. 7

(a)

| + | - | + | - | + | - |
|---|---|---|---|---|---|
| R1 | G1 | B1 | R2 | G2 | B2 |
| 80 | 80 | 60 | 58 | 80 | 85 |

(b)

| + | - | - | + | + | - |
|---|---|---|---|---|---|
| R1 | G1 | B1 | R2 | G2 | B2 |
| 80 | 80 | 60 | 58 | 80 | 85 |

LIQUID CRYSTAL DISPLAY DEVICE HAVING A 1-DOT INVERSION OR 2-DOT INVERSION SCHEME AND METHOD THEREOF

CROSS REFERENCE TO RELATED APPLICATION

This application claims the benefit of the Korean Patent Application No. 10-2010-0134951, filed on Dec. 24, 2010, which is hereby incorporated by reference as if fully set forth herein.

BACKGROUND OF THE DISCLOSURE

1. Field of the Disclosure

The present invention relates to a liquid crystal display device and a method for driving the same, more particularly, to a liquid crystal display device driven according to a group control of dynamic polarity control (DPC), which can use an inversion control optimized for each of patterns and more specified by grouping channels, and a method for driving the same.

2. Discussion of the Related Art

According to a conventional liquid crystal display device, a liquid crystal layer having dielectric anisotropy is formed between an upper substrate and a lower substrate. After that, an electric field density formed on the liquid crystal layer is adjusted and molecular arrangement of the liquid crystal material is converted. Because of that, the quantity of lights transmitted via the upper substrate which is a display surface is adjusted and a desired image is presented.

Such a crystal display device includes a liquid crystal panel configured of a plurality of pixels to display an image, a driving circuit for driving the liquid panel and a backlight for projecting a light toward the liquid crystal panel.

An equivalent circuit of each of the pixels composing the liquid crystal panel includes gate lines and data lines crossed with each other, thin film transistors and pixel electrodes arranged at intersections between the gate and data lines, respectively, and liquid capacitors and storage capacitors aligned based on a pixel unit.

The equivalent circuit for each pixel having the above configuration will be driven as follows.

First of all, a scan signal is applied to the thin film transistor and the thin film transistor is turned on. If then, a data voltage corresponding to image data of the pixels is selected to be applied to each pixel via each of the data lines, respectively. The image data is a digital signal capable of presenting a gray level and it is set to have a predetermined level of 0~225.

After that, an electric field generated by a difference between the data voltage applied to each pixel and a common voltage may be supplied to the liquid crystal capacitor. The light is transmitted based on a predetermined transmittance corresponding to the density of the electric field. At this time, the storage capacitor maintains the data voltage applied to the corresponding pixel for a single frame.

When the electric field having the same polarity is applied to the liquid crystal capacitor continuously, the liquid crystal forming the liquid crystal capacitor might be degraded and a flicker might be generated.

To prevent the flicker and to improve an image quality, inversion control driving which inverts the polarity of the data voltage based on a predetermined unit may be used. The inversion control driving may be categorized, based on a unit of polarity inversion, into frame inversion, line inversion, column inversion and dot inversion control driving.

However, even if displaying images based on the dot inversion driving control in case of displaying a vertical line pattern against a gray background or a horizontal line pattern with a large contrast, a specific pattern image, for example, common voltage distortion might be generated and an error of the image quality such as smear might be generated on a display screen. Because of that, in recent there have been studied devices and control methods which can detects predetermined error patterns where the smear is generated, when image data is input, and which implements the inversion control driving when a smear generation pattern is detected. A rising one of the methods for detecting the smear generation pattern according to a prior art is that error pattern information is set to detect a smear generation pattern, to compare image data with the preset error pattern information.

However, according to the conventional detecting method of error pattern, for example, smear generation pattern, the inversion control is converted frequently if brightness of an image and a pattern of the image are changed a lot. Because of that, image display errors might occur. In other words, pattern recognition of/off of images might be inverted frequently according to a ratio of preset patterns, for example, movement of a folder window or a menu bar and movement of a mouse near a threshold, to generate a display error of flicker referring to a phenomenon that a screen is flickering. However, each of the inversion controls would generate severe noise when a specific frame pattern is displayed on the liquid crystal panel. For example, in case of the dot inversion control which drives neighboring pixels along horizontal and vertical directions to have different polarities, a severe flicker might be generated when a dot inversion pattern is displayed on the liquid crystal panel.

Because of that, in recent have been proposed charge share control which can drive a data driver optimized to a pattern by recognizing a worst pattern and dynamic polarity control (DPC) which can improve image quality deterioration, with lowering a temperature by variation of horizontal inversion.

A conventional DCP driving liquid crystal display device will be described as follows.

FIG. 1 is a diagram illustrating a configuration of a driving circuit provided in a conventional liquid crystal display device and FIG. 2 is a diagram illustrating a timing controller shown in FIG. 1.

As shown in FIG. 1, the conventional DPC driving liquid crystal display device includes a liquid crystal panel 2 having a plurality of gate lines (GL1 to GLn) and a plurality of data lines (DL1 to DLm) and a plurality of pixel areas, a data driver 4 for driving the data lines; a gate driver 6 for driving the gate lines; a timing controller 8 for controlling the gate and data drivers 6 and 4 by generating a gate control signal (GCS) and a data control signal (DCS), based on external synchronization signals (DCLK, DE, Hsync and Vsync), and by supplying the generated gate control signal (GCS) and data control signal (DCS) to the gate driver 6 and the data driver 4, respectively, and for converting an inversion control of the liquid crystal panel 2, when an error pattern is detected based on result of error pattern recognition and result of external input image data (RGB) analysis.

Here, as shown in FIG. 2, the timing controller 8 includes an image processing unit 11 for arranging external image data (RGB) to be proper to a driving of the liquid crystal panel 2 and outputting the arranged image data (RGB) to the data driver 4; a low voltage differential signaling (LVDS) output unit 12 for outputting source start pulse (SSP), source shift clock (SSC), source output enable signals and polarity control signals (POL) to the data driver 4, based on the image signals processed in the image processing unit 11 and the external synchronization signals; a pattern recognizing unit 13 for outputting a horizontal 2-dot inversion polarity control signal by analyzing input image data (RGB) in a state of recognizing a worst pattern and by detecting that the input image data is an error pattern based on the result of the analysis; and a H-dot converting unit 14 for outputting a horizontal 2-dot signal (H2 Dot signal) to drive the data driver 4 according to horizontal 2 Dot inversion control, based on the horizontal 2-dot inversion polarity control signal of the pattern recognizing unit 13.

Here, the pattern recognizing unit 13 analyzes image data for a single line or image data for a single frame, to recognize the error pattern.

A driving method for the conventional DPC driving control liquid crystal display device having the above configuration will be described as follows.

That is, the timing controller 8 arranges the external input image data to be proper to the driving of the liquid crystal panel 2. The timing controller 8 generates the gate control signal (GCS) including gate start pulse (GSP), gate shift clock (GCS) and gate output enable (GOE) signals based on the external synchronization signals (DCLK, DE, Hsync and Vsync), to supply the generated gate control signal to the gate driver 6. The timing controller 8 supplies source start pulse (SSP), source shift clock (SSC) and source output enable (SOE) signals, and polarity control signals (POL) and the arranged image data to the data driver 4, based on the external synchronization signals (DCLK, DE, Hsync and Vsync).

The gate driver 6 sequentially generates scan pulses in response to the gate control signal (GCS) transmitted from the timing controller 8, and it supplies the scan pulses to the gate lines (GL1 to GLn) of the liquid crystal panel 2 sequentially.

The data driver 4 converts the arranged image data (Data) from the timing controller 8 into analog voltages by using the data control signal (DCS) from the timing controller 8 and it supplies the analog voltages to the data lines (DL1 to DLm), respectively. That is, after latching the image data (Data) arranged by the timing controller 8 according to the SSC, the data driver 4 supplies the data lines (DL1 to DLm) image signals for a single horizontal line per single horizontal frame where the scan pulses are supplied to the gate lines (GL1 to GLn) in response to the SOE signal. At this time, the data driver 4 selects a positive or negative gamma voltage having a predetermined level corresponding to a gray scale value of the image data (Data) arranged to correspond to the POL signal. The data driver 4 supplies the selected gamma voltage to the data lines (DL1 to DLm) as image signals.

In the meanwhile, the timing controller 8 recognizes the error pattern by using the pattern recognizing unit 13 and the H-dot converting unit 14, and it analyzes the external input image data (RGB). When the error pattern is detected based on the result of the analysis, the timing controller 8 outputs a horizontal-2-dot signal (H2 Dot signal) capable of converting the inversion driving control of the liquid crystal panel 2.

The data driver 4 drives the liquid crystal panel 2 according to a horizontal-1-dot inversion control at normal image data not detected as error pattern. When receiving the horizontal-2-dot signal (H2 Dot signal) from the image data (RGB) recognized as error pattern, the data driver 4 drives the liquid crystal panel 2 according to the horizontal-2-dot inversion control.

However, the conventional DPC driving liquid crystal display device may have following disadvantages.

First of all, the image data input to recognize the error pattern is analyzed for a single line or frame. Because of that, a predetermined area not proper to an overall driving control might exist. Together with that, image quality deterioration might be generated at a minute area.

Furthermore, the driving mode is controlled by the horizontal-2-dot signal (H2 Dot signal) of the timing controller. Because of that, the number of channels or the driving order cannot be controlled. In the single frame, a polarity period, horizontal-2 dot cannot be varied.

SUMMARY OF THE DISCLOSURE

Accordingly, the present invention is directed to a liquid crystal display device and a method for driving the liquid crystal display device.

An object of the present invention is to provide a liquid crystal display device driven according to a group control of dynamic polarity control (DPC), which can use an inversion control optimized for each of patterns and more specified by grouping channels, and a method for driving the same.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device includes a liquid crystal panel comprising a plurality of gate lines (GL1 to GLn), data lines (DL1 to DLm) and a plurality of pixel areas; a timing controller arranging the external input image data to be proper to the driving of the liquid crystal panel, generating a gate control signal (GCS) and a data control signal (DCS), and grouping the arranged image data into a plurality of groups each having a plurality of controller channels, and outputting a group control signal (HINV_m) by determining whether each group of the arranged image data is proper to horzintal-1-dot inversion or horizontal-2-dot inversion; a gate driver driving the plurality of the gate lines of the liquid crystal panel based on the gate control signal (GCS) from the timing controller; and a data driver grouping output terminals thereof into a plurality of groups, the number of the groups grouped by the data driver corresponding to the number of the groups grouped by the timing controller, selecting positive or negative gamma voltages corresponding to the arranged image data for each group based on the group control signal from the timing controller, and converting the arranged image data into an analog image signals by using the selected gamma voltage.

The timing controller may include an image processing unit arranging an external image data (RGB) to be proper to the driving of the liquid crystal panel, and generating the gate control signal (GDS) and the data control signal (DCS) by using an external input synchronization; a group control unit grouping the arranged image data from the image processing unit into a plurality of groups each having a plurality of controller channels, determining whether every group of arranged image data is proper to the horizontal-1-dot inversion or the horizontal-2-dot inversion, and outputting a group control signal (HINV_m) according to the result of the determining; a LVDS output unit outputting the arranged image signal, the data control signal (DCS) from the image processing unit, and the group control signal (HINV_m) from the group control unit to the data driver.

The LVDS output unit may be an embedded panel interface (EPI) LVDS output unit. 8-bit-6-pair lines may be formed between the EPI LVDS output unit and the data driver to transfer the arranged image data. Additionally, the group control signal (HINV_m) may be included in the lines for transferring the arranged image data.

The LVDS output unit may be a mini LVDS output unit. 8-bit-6-pair lines may be formed between the mini LVDS output unit and the data driver to transfer the arranged image data. Additionally, a 1-pair line may be further provided in the 8-bit-6-pair lines to transfer the group control signal (HIVM (m)).

The data driver may include a latch unit latching the arranged image data from the timing controller based on the data control signal from the timing controller, and outputting the latched image data; a digital/analog converting unit selecting positive or negative gamma voltages corresponding to the arranged image data for each group from the latch unit based on the group control signal from the timing controller, and converting the arranged image data into an analog image signals by using the selected gamma voltage; and an output unit grouping the analog image signals converted by the digital/analog into groups based on the group control signal (HINV_m), the number of the groups grouped by the output unit corresponding to the number of the groups grouped by the timing controller, and supplying each group of the analog image signals to the data lines.

The single group may include 6 channels or 12 channels.

In another aspect of the present invention, a method for driving a liquid crystal display device includes grouping image data into a plurality of groups each having a plurality of controller channels; generating a group control signal (HINV_m) by determining whether each group of the arranged image data is proper to horzintal-1-dot inversion or horizontal-2-dot inversion; and grouping output terminals of the data driver into a plurality of groups, the number of the groups of the output terminals corresponding to the number of the groups of the image data, to supply an analog signal to the data lines according to the group control signal. The step of generating the group control signal may comprise calculating a first data variation (H1_m) of the image data for each group in case of a horizontal-1-dot inversion and a second data variation (H2_m) of the image data for each group in case a horizontal-2-dot inversion, according to a polarity control signal input from outside; comparing the first data variation (H1_m)with the second data variation (H2_m); outputting a first group control signal to drive according to the horizontal-1-dot inversion, when first data variation (H1_m) is smaller than the second data variation (H2_m); outputting a second group control signal to drive according to the horizontal-2-dot inversion, when the first data variation (H1_m) is larger than the second data variation (H2_m).

the first data variation (H1_m) and the second data variation (H2_m) may be absolute values of a difference between the total of positive data and the total of negative data in each group of image data.

The method for driving the liquid crystal display device may further include outputting the first group control signal to drive according to the horizontal-1-dot inversion, when the first data variation (H1_m) is identical to the second data variation (H2_m) by "0"; and outputting a second group control signal to drive according to the horizontal-2-dot inversion, when the first data variation (H1_m) is larger than the second data variation (H2_m).

a polarity control signal is inverted, and the first and second data variations (H1_m and H2_m) for the next group of image data are calculated based on the inverted polarity control signal, when the first data variation (H1_m) is identical to the second data variation (H2_m) by a predetermined value except "0".

An internal POL is inverted again to be the original POL and each of the data variations (H1_m and H2_m) is calculated, when the horizontal-2-dot inversion is determined for the next group after controlling according to the horizontal-2-dot inversion.

Therefore, the liquid crystal display device having the above configuration and the method for driving the same may have a following advantage.

That is, not recognizing a pattern based on a predetermined error pattern to control inversion control driving, data for each of the groups is read and a data variation in case of a horizontal-1-dot is compared with a data variation in case of a horizontal-2-dot, to select an inversion control driving with less data variation. Because of that, control may be performed for more specified areas and an image quality may be improved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings:

FIGS. 7(*a*) and 7(*b*) are diagrams illustrating operation of the group control unit: FIG. 7(*a*) illustrates a horizontal-1-dot inversion and FIG. 7(*b*) illustrates a horizontal-2-dot inversion.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
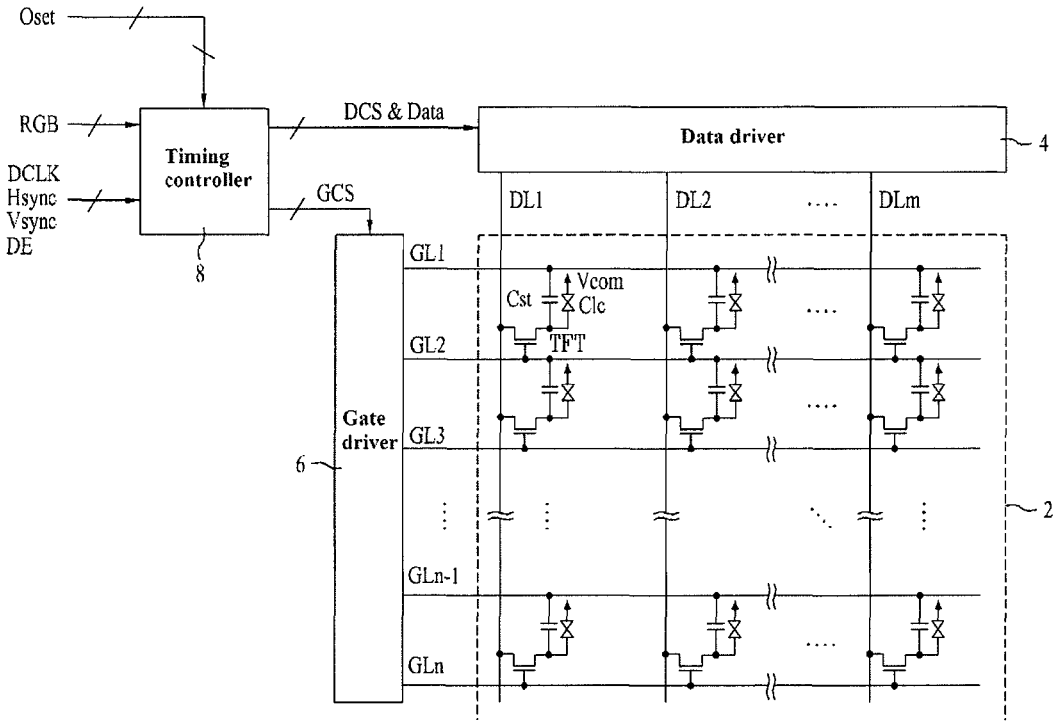
FIG. 1 Related art
FIG. 1 is a diagram illustrating a configuration of a driving circuit provided in a conventional liquid crystal display device.
Figure 2:
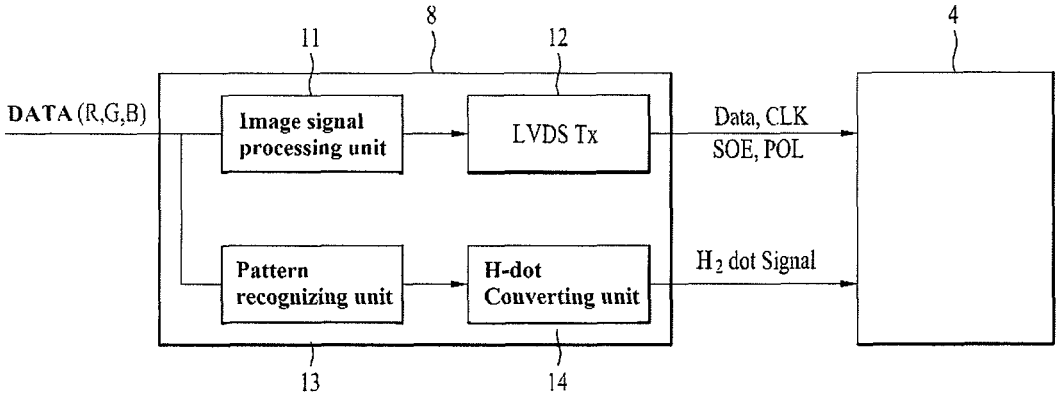
FIG. 2 Related Art
FIG. 2 is a diagram illustrating a timing controller shown in FIG. 1.
Figure 3:
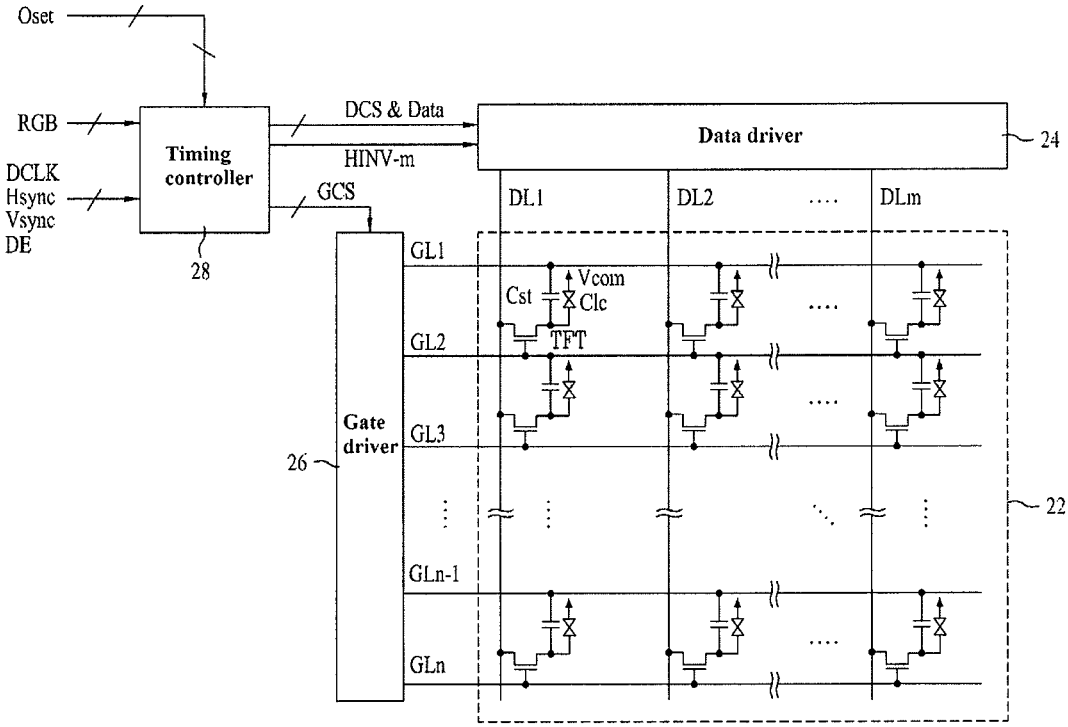
FIG. 3 is a diagram illustrating a configuration of a liquid crystal display device according to an exemplary embodiment of the present invention.
Figure 4:
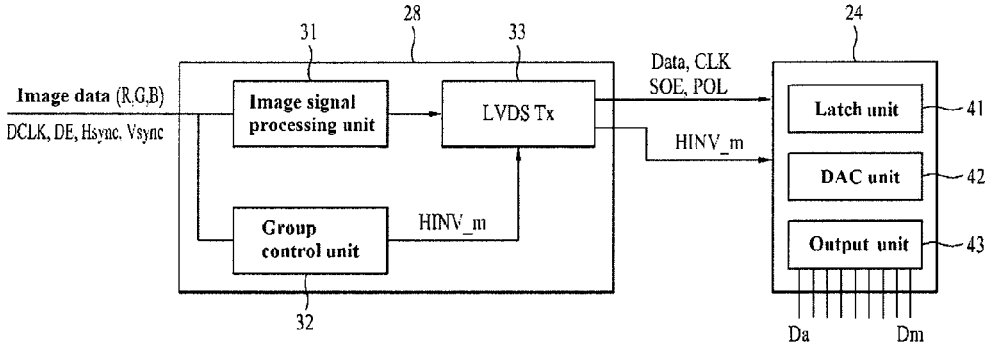
FIG. 4 is a diagram illustrating a timing controller and a data driver shown in FIG. 3.
Figure 5:
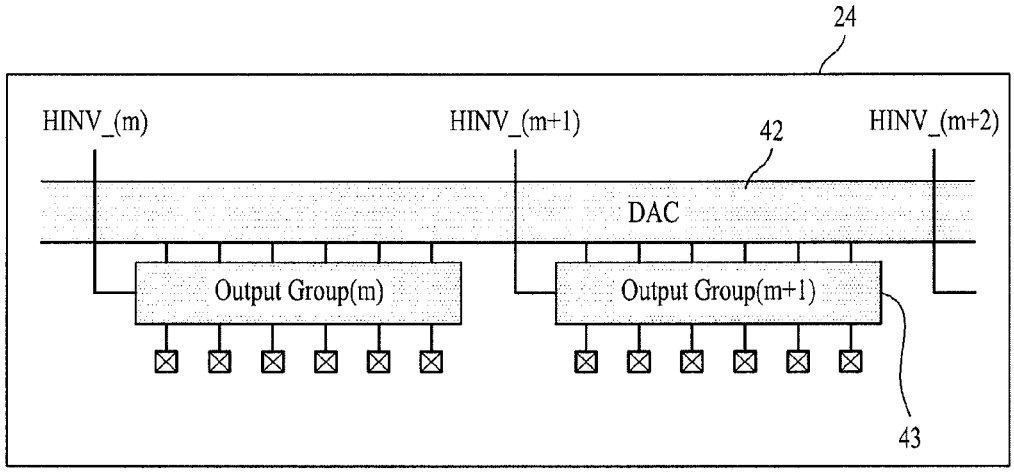
FIG. 5 is a diagram illustrating an output unit of the data driver shown in FIG. 4.

FIG. 3 is a diagram illustrating a configuration of a liquid crystal display device according to an exemplary embodiment of the present invention. FIG. 4 is a diagram illustrating a timing controller and a data driver shown in FIG. 3. FIG. 5 is a diagram illustrating an output unit of the data driver shown in FIG. 4.

As shown in FIG. 3, the liquid crystal display device according to the present invention includes a liquid crystal panel 22, a timing controller 28, a gate driver 26 and a data driver 24.

The liquid crystal panel 22 may include a plurality of gate lines (GL1 to GLn) and a plurality of data lines (DL1 to DLm) and a plurality of pixel areas.

The timing controller 28 arranges the external input image data to be proper to the driving of the liquid crystal panel 22. The timing controller 28 may generate a gate control signal (GCS) including gate start pulse (GSP), gate shift clock (GCS) and gate output enable (GOE) signals, and a data control signal (DCS) including source start pulse (SSP), source shift clock (SSC) and source output enable signals, by using external synchronization signals (DCLK, DE, Hsync and Vsync). The timing controller 28 may output the gate control signal (GCS) to the gate driver 26, and output the data control signal (DCS) to the data driver 24. In addition, the timing controller 28 may group the arranged image data into a plurality of groups, each group having a plurality of controller channels, and may determine whether each group of the arranged image data is proper to horzintal-1-dot inversion or horizontal-2-dot inversion, to output a corresponding group control signal (HINV_m).

The gate driver 26 may drive the plurality of the gate lines of the liquid crystal panel 22 according to the gate control signal (GCS) from the timing controller 28. The data driver 24 may convert the arranged image data (Data) from the timing controller 28 by using the data control signal (DCS) from the timing controller 28, and it may select a positive or negative gamma voltage having a predetermined level corresponding to a gray scale value of the arranged image data (Data) for each group by grouping output terminals thereof into a plurality of groups, the number of the groups of output terminals grouped by the data driver 24 corresponding to the number of the groups of arranged image data grouped by the timing controller 28 based on the group control signal from the timing controller 28, and convert the arranged image data into analog image signals by using the selected gamma voltages. In addition, the data driver 24 may supply the analog image signals to the data lines (DL1 to DLm).

Here, as shown in FIG. 4, the timing controller 28 includes an image processing unit 31, a group control unit 32, and a LVDS output unit 33.

The image processing unit 31 may arrange the external image data (RGB) to be proper to the driving of the liquid crystal panel 22, and may generate the gate control signal (GDS) and the data control signal (DCS), by using the external input synchronization signals (DCLK, DE, Hsync and Vsync).

The group control unit 32 may group the arranged image data from the image processing unit 31 into a plurality of groups each having a plurality of controller channels, and may determine whether every group of the arranged image data is proper to the horizontal-1-dot inversion or horizontal-2-dot inversion and output a corresponding group control signal (HINV_m) based on the determination.

The LVDS output unit 33 may output the arranged image signal and data control signal (DCS) from the image processing unit 31 and the group control signal (HINV_m) from the group control unit 32 to the data driver 24.

Here, the LVDS output unit 33 may be an Embedded Panel Interface(EPI) LVDS output unit. 8-bit-6-pair lines may be formed between the EPI LVDS output unit and the data driver 24 to transfer the arranged image data together with the group control signal. The group control signal (HINV_m) is included in the 8-bit-6-pair lines for transferring the arranged image data.

Alternatively, the LVDS output unit 33 may be a mini LVDS output unit. 8-bit-6-pair lines may be formed between the mini LVDS output unit and the data driver 24 to transfer the arranged image data. In addition, a 1-pair line may be further provided in the 8-bit-6-pair lines to transfer the group control signal (HIVM(m)).

As shown in FIG, 4, the data driver 24 includes a latch unit 41, a digital/analog converting unit 42 and an output unit 43. The latch unit 41 may latch the arranged image data from the timing controller 28 according to the data control signals from the timing controller 28 (e.g., the source start pulse (SSP) and the source sampling clock (SSC)), and may output the latched image data according to the source output enable signal (SOE). The digital/analog converting (DAC) unit 42 may select a positive gamma compensating voltage (GH) or a negative gamma compensating voltage (GL) corresponding to the arranged image data from the latch unit 41 for each group according to the group control signal (HINV_m) from the timing controller 28, and convert the arranged image data into analog image signals by using the selected gamma voltages. Based on the group control signal (HINV_m) from the timing controller 43, the output unit 43 may group the analog image signals from the digital/analog converting part 42 into groups, the number of the groups grouped by the output unit 43 corresponding to the number of the groups grouped by the timing controller 28, to supply each group of the image signals to the data lines (D1 to Dk).

FIG. 5 is a diagram illustrating an output unit of the data driver shown in FIG. 4. As shown in FIG. 5, output terminals of the output unit 43 (such as output group (m), output group (m+1)) are grouped into a number of groups, the number of the groups of the output terminals corresponding to the number of the groups of the arranged image data which are grouped by the timing controller 28. The number of the output terminals of each group grouped by the data driver 24 corresponds to the number of the controller channel of the each group grouped by the timing controller 28. Because of that, the output unit 43 may output the groups of the image data in response to the group control signals, such as the group control signals HINV_(m), HINV_(m+1), HINV_(m+2).

As follows, a driving method of the liquid crystal display device having the above configuration will be described with reference to FIG. 6, FIG. 7(*a*) and FIG. 7(*b*).

Figure 6:
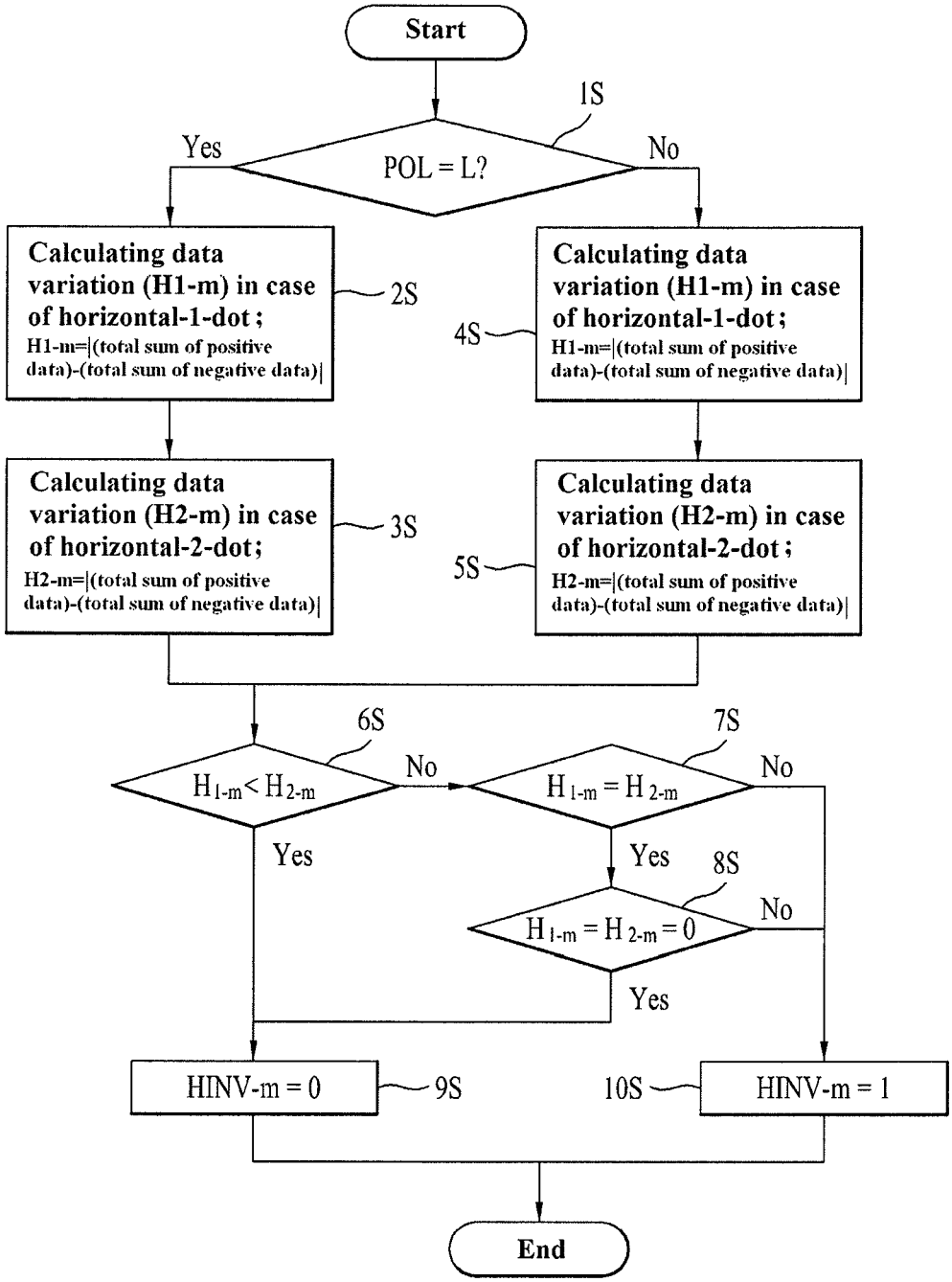
FIG. 6 is an operational flow chart of a group control unit provided in the timing controller of the liquid crystal display device according to the present invention.

FIG. 6 is an operational flow chart of a group control unit provided in the timing controller of the liquid crystal display device according to the present invention. FIGS. 7(*a*) and 7(*b*) diagrams illustrating operation of the group control unit, including FIG. 7(*a*) illustrating a horizontal-1-dot inversion and FIG. 7(*b*) illustrating a horizontal-2-dot inversion.

First of all, each group may have a plurality of controller channels. Putting the RGB structure of the liquid crystal display panel and the horizontal-1-dot (H 1 D) inversion and the horizontal-2-dot (H 2 Dot) inversion into consideration, it is proper that each group has 6 or 12 controller channels. As an example, an embodiment of the present invention presents a group of 6 controller channels (2 pixel data).

Polarity arrangement of the image data may be varied according to a low level (L) or a high level (H) of a polarity control signal (POL) which is input from the outside. For example, in case of POL=L, the polarity arrangement of the horizontal-1-dot inversion may be "+, −, +, −, +, −", and the polarity arrangement of the horizontal-2-dot inversion may be "+, −, −, +, +, −". In case of POL=H, the polarity alignment of the horizontal-1-dot inversion may be "−, +, −, +, −, +", and the polarity alignment of the horizontal-2-dot inversion may be "−, +, +, −, −, +". FIGS. 7(*a*) and 7(*b*) illustrate the case of POL=L.

FIGS. 7(*a*) and 7(*b*) show that 8-bit values of external input 2-pixel (6-channel) image data may be "80, 75, 60, 58, 90, 85".

As shown in FIG. 6, first, the group control unit 32 of the timing controller 28 reads the arranged image data for each group and determines the state of the polarity control signal (POL). Then, it calculates a data variation (H1_m) in case of the horizontal-1-dot inversion and a data variation (H2_m) in case of the horizontal-2-dot inversion, based on the POL state, (Steps 2S, 3S, 4S and 5S).

That is, the data variation (H1_m and H2_m) is an absolute value of a difference between the total of the positive data and the total of the negative data for each group of arranged image data.

For example, as shown in FIGS. 7(*a*) and 7(*b*), in case of the horizontal-1-dot inversion, the total of the positive data is "80+60+80=220" and the total of the negative data is "80+58+85=223". Because of that, the data variation (H1_m) in case of the horizontal-1-dot inversion may be "3".

In case of the horizontal-2-dot inversion, the total of the positive data is "80+58+80=218" and the total of the negative data is "80+60+85=225". Because of that, the data variation (H2_m) in case of the horizontal-2-dot inversion may be "7".

Then, the two data variations (H1_m and H2_m) are compared with each other (Step 6S).

When the data variation (H1_m) in case of the horizontal-1-dot inversion is smaller than the data variation (H2_m) in case of the horizontal-2-dot inversion based on the result of the comparison, a corresponding group control signal (HINV_m=0) is output to drive the liquid crystal display panel in the horizontal-1-dot inversion (Step 9S).

When the data variation in case of the horizontal-1-dot inversion is identical to the data variation (H2_m) in case of the horizontal-2-dot inversion by "0" based on the result of the comparison (Steps 7S and 8S), the corresponding group control signal (HINV_m=0) is output to drive the liquid crystal display panel in the horizontal-1 dot inversion (Step 9S).

When the data variation in case of the horizontal-1-dot inversion is identical to the data variation (H2_m) in case of the horizontal-2-dot inversion by another value except "0" based on the result of the comparison or when the data variation (H1_m) in case of the horizontal-1-dot inversion is larger than the data variation (H2_m) in case of the horizontal-2-dot inversion based on the result of the comparison (Steps 7S and 8S), a corresponding control signal (HINV_m=1) is output to drive the liquid crystal display panel in the horizontal-2-dot inversion (10S).

If the horizontal-2-dot inversion is selected to drive the liquid crystal display panel when the data variation in case of the horizontal-1-dot inversion is identical to the data variation (H2_m) in case of the horizontal-2-dot inversion by another value except "0", POL is inverted, the calculation of the data variations (H1_m and H2_m) for the next group of arranged image data is performed based on the inverted POL. Thereby, horizontal-2-dot inversion balance may be maintained.

If for the next group of image data, the horizontal-2-dot inversion is selected to the liquid crystal display panel, internal POL of the next group image data is inverted again, to be identical to the original POL.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

a liquid crystal panel comprising a plurality of gate lines (GL1 to GLn), data lines (DL1 to DLm) and a plurality of pixel areas;

a timing controller arranging the external input image data to be proper to the driving of the liquid crystal panel, generating a gate control signal (GCS) and a data control signal (DCS), and grouping the arranged image data into a plurality of groups each having a plurality of controller channels, and outputting a group control signal (HINV_m) by determining whether each group of the arranged image data is proper to horizontal-1-dot inversion or horizontal-2-dot inversion;

a gate driver driving the plurality of the gate lines of the liquid crystal panel based on the gate control signal (GCS) from the timing controller; and a data driver grouping output terminals thereof into a plurality of groups, the number of the groups grouped by the data driver corresponding to the number of the groups grouped by the timing controller, selecting positive or negative gamma voltages corresponding to the arranged image data for each group based on the group control signal from the timing controller, and converting the arranged image data into an analog image signals by using the selected gamma voltage, wherein the timing controller comprises:

an image processing unit arranging an external image data (RGB) to be proper to the driving of the liquid crystal panel, and generating the gate control signal (GDS) and the data control signal (DCS) by using an external input synchronization, a group control unit grouping the arranged image data from the image processing unit into a plurality of groups each having a plurality of controller channels, determining whether every group of arranged image data is proper to the horizontal-1-dot inversion or the horizontal-2-dot inversion, and outputting a group control signal (HINV_m) according to the result of the determining, and a low voltage differential signaling (LVDS) output unit outputting the arranged image signal, the data control signal (DCS) from the image processing unit, and the group control signal (HINV_m) from the group control unit to the data driver.

2. The liquid crystal display device of claim 1, further comprising:

8-bit-6-pair lines are formed between the LVDS output unit and the data driver to transfer the arranged image data together with the group control signal, and the group control signal (HINV_m) is included in the 8-bit-6-pair lines for transferring the arranged image data, and wherein the LVDS output unit is an embedded panel interface (EPI) LVDS output unit.

3. The liquid crystal display device of claim 1, further comprising:

8-bit-6-pair lines are formed between the LVDS output unit and the data driver to transfer the arranged image data, and a 1-pair line is further provided in the 8-bit-6-pair lines to transfer a group control signal (HIVM(m)),and wherein the LVDS output unit is a mini LVDS output unit.

4. The liquid crystal display device of claim 1, wherein the data driver comprises:

a latch unit latching the arranged image data from the timing controller based on the data control signal from the timing controller, and outputting the latched image data;

a digital/analog converting unit selecting positive or negative gamma voltages corresponding to the arranged image data for each group from the latch unit based on the group control signal from the timing controller, and converting the arranged image data into an analog image signals by using the selected gamma voltage; and an output unit grouping the analog image signals converted by the digital/analog converting part into groups based on the group control signal (HINV_m), the number of the groups grouped by the output unit corresponding to the number of the groups grouped by the timing controller, and supplying each group of the analog image signals to the data lines.

5. The liquid crystal display device of claim 1, wherein each group comprises 6 channels or 12 channels.

6. A method for driving a liquid crystal display device comprising:

grouping image data into a plurality of groups each having a plurality of controller channels;

generating a group control signal (HINV_m) by determining whether each group of the arranged image data is proper to horizontal-1-dot inversion or horizontal-2-dot inversion; and grouping output terminals of the data driver into a plurality of groups, the number of the groups of the output terminals corresponding to the number of the groups of the image data, to supply an analog signal to the data lines according to the group control signal, wherein the step of generating the group control signal comprises:

calculating a first data variation (H1_m) of the image data for each group in case of a horizontal-1-dot inversion and a second data variation (H2_m) of the image data for each group in case a horizontal-2-dot inversion, according to a polarity control signal input from outside;

comparing the first data variation (H1_m)with the second data variation (H2_m);

outputting a first group control signal to drive according to the horizontal-1-dot inversion, when the first data variation (H1_m) is smaller than the second data variation (H2_m); and outputting a second group control signal to drive according to the horizontal-2-dot inversion, when the first data variation (H1_m) is larger than the second data variation (H2_m).

7. The method for driving the liquid crystal display device of claim 6, wherein the first data variation (H1_m) and the second data variation (H2_m) are absolute values of a difference between the total of positive data and the total of negative data in each group of image data.

8. The method for driving the liquid crystal display device of claim 6, further comprising:

outputting the first group control signal to drive according to the horizontal-1-dot inversion, when the first data variation (H1_m) is identical to the second data variation (H2_m)by "0"; and outputting the second group control signal to drive according to the horizontal-2-dot inversion, when the first data variation (H1_m) is identical to the second data variation (H2_m) by a predetermined value except "0".

9. The method for driving the liquid crystal display device of claim 6, wherein a polarity control signal is inverted, and the first and second data variations (H1 _m and H2_m) for the next group of image data are calculated based on the inverted polarity control signal, when the first data variation (H1_m) is identical to the second data variation (H2_m) by a predetermined value except "0".

* * * * *